United States Patent [19]

Tapper et al.

[11] Patent Number: 4,917,062

[45] Date of Patent: Apr. 17, 1990

[54] CYLINDER HEAD GASKET ELIMINATION PROCESS

[76] Inventors: Thomas E. Tapper, 1128 Solly Ave., Philadelphia, Pa. 19111; Jeffrey Cesari, 9996 Woodfern Rd., Philadelphia, Pa. 19115

[21] Appl. No.: 339,213

[22] Filed: Apr. 17, 1989

[51] Int. Cl.[4] ..... F02F 1/00

[52] U.S. Cl. ..... 123/193 CH; 123/193 H

[58] Field of Search ..... 123/193 C, 193 CH, 193 R, 123/41.84, 194 H; 277/167.5, 235 B

[56] References Cited

U.S. PATENT DOCUMENTS

| | | | |
|---|---|---|---|
| 2,528,665 | 11/1950 | Peterson et al. | 123/193 CH |
| 2,553,222 | 5/1951 | Wallgren et al. | 123/193 CH |
| 2,972,341 | 2/1961 | Forst | 123/193 CH |
| 3,125,082 | 3/1964 | Stensfield et al. | 123/193 CH |
| 3,209,659 | 10/1965 | Colwell | 123/41.84 |
| 4,513,703 | 4/1985 | Eckert | 123/193 CH |

FOREIGN PATENT DOCUMENTS

| | | | |
|---|---|---|---|
| 3023782 | 1/1981 | Fed. Rep. of Germany | 277/167.5 |

*Primary Examiner*—Willis R. Wolfe

*Assistant Examiner*—M. Macy

*Attorney, Agent, or Firm*—Leon Gilden

[57] ABSTRACT

A process for elimination of a conventional head gasket as typically utilized in an internal combustion engine, and more particularly in a motorcycle engine, is set forth wherein the cylinder head is removed from the associated engine block. The cylinder head is formed with a coaxially aligned groove of rectangular cross-sectional configuratiion. A complementary groove of equal diameter and axially aligned with the groove formed about the combustion chamber is formed into the engine block. An "O" ring of a cross-sectional area greater than that of the combined cross-sectinal area of the groove formed in the cylinder head and of the groove in the engine block is positioned within the grooves whereupon securement of the cylinder head to the engine block compresses the "O" ring within the aligned grooves to effect sealing of the engine block to the groove. Additionally, complementary "O" rings are formed about the coolant lines within the cylinder head and engine block to sealingly contain coolant flow within such passages between the cylinder head and engine block.

4 Claims, 1 Drawing Sheet

CYLINDER HEAD GASKET ELIMINATION PROCESS

BACKGROUND OF THE INVENTION

1. Field of the Invention

The field of invention relates to methods and apparatus for securing a cylinder head to an engine block wherein the instant invention sets forth an improved cylinder head gasket elimination process to substitute "O" rings within aligned grooves within the cylinder head engine block to secure the cylinder head to the engine block in a sealing arrangement.

2. Description of the Prior Art

The use of various methods for effecting sealing of a cylinder head to an engine block have been heretofore set forth in the prior art. The prior art, however, has not addressed the securement of relatively small bore engines as typically utilized in motorcycle apparatus. Prior art sealing of the cylinder head to the engine block has adopted various forms and in this respect an example may found in U.S. Pat. No. 3,209,659 to Colwell setting forth a sealing ring for positioning within a groove adjacent a cylinder bore, but fails to provide the associated groove within the cylinder head. Further, the Colwell patent does not set forth the use of conventional "O" ring organizations within remaining cylinder head and engine block environments.

U.S. Pat. No. 3,800,751, to Glassey illustrates the use of "O" rings in sealing a cylinder liner within an engine block.

U.S. Pat. No. 4,399,783 to Hauser sets forth a cylinder liner positioned within an engine block and utilizing various sealing members aligned between the cylinder liner and the engine block to effect sealing between the air and internal combustion engine.

U.S. Pat. No. 4,505,234 to Meiners sets forth a sleeve insert positioned within a typical engine block utilizing various "O" rings within grooves coaxially about the liner to effect sealing thereof.

U.S. Pat. No. 3,882,842 to Bailey, et al., is set forth as a further example of a sealing arrangement between a cylinder liner and an engine block and utilizing a conventional gasket between the cylinder head and engine block.

As such, it may be appreciated that the prior art has heretofore failed to address the problems to effect sealing and enhance engine performance, as does the instant invention, and in this respect, the present invention substantially fulfills this need. It should be noted further that in the elimination of the head gasket, the effective and mechanical compression ratio of the engine is raised to enhance performance of the associated engine.

SUMMARY OF THE INVENTION

In view of the foregoing disadvantages inherent in the known types of engine sealing procedures now present in the prior art, the present invention provides a cylinder head gasket elimination process wherein the same eliminates the need in the conventional use of head gaskets in the securement of a cylinder head to an associated engine block while simultaneously increasing the operating efficiency of the associated engine. As such, the general purpose of the present invention, which will be described subsequently in greater detail, is to provide a new and improved cylinder head gasket elimination process which has all the advantages of the prior art cylinder head to engine block sealing technics and none of the disadvantages.

To attain this, the present invention comprises a process for the elimination of a cylinder head gasket in an internal combustion engine wherein the cylinder head is removed from the associated cylinder block. Subsequently coaxial grooves of a rectangular cross-sectional configuration are formed about the associated cylinder bores wherein the grooves are of a predetermined diameter. The cylinder head is formed with further grooves coaxially aligned with the grooves formed about the cylinder bores. Further, grooves are formed about coolant passages formed in the cylinder block and wherein complementary grooves of companion cross-sectional configurations are formed in the cylinder head about the coolant passages. Resilient polymeric "O" rings of a cross-sectional area greater than that of the cross-sectional area of the groove formed in the cylinder head and the groove formed in the engine block are positioned within the cylinder head and upon the securement of the cylinder head of the engine block, the associated "O" ring is compressed and sealingly contains combustion pressure and coolant, such as oil or water, within the associated bores.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cylinder head gasket elimination process which has all the advantages of the prior art and none of the disadvantages.

It is another object of the present invention to provide a new and improved cylinder head gasket elimination process which may be easily and efficiently manufactured and marketed.

It is a further object of the present invention to provide a new and improved cylinder head gasket elimination process which is of a durable and reliable construction.

An even further object of the present invention is to provide a new and improved cylinder head gasket elimination process which is susceptible of a low cost of manufacture with regard to both materials and labor, and which accordingly is then susceptible of low prices of sale to the consuming public, thereby making such cylinder head gasket elimination processes economically available to the buying public.

Still yet another object of the present invention is to provide a new and improved cylinder head gasket elimination process which provides in the apparatuses and methods of the prior art some of the advantages thereof, while simultaneously overcoming some of the disadvantages normally associated therewith.

Still another object of the present invention is to provide a new and improved cylinder head gasket elimination process wherein confronting grooves are formed in the cylinder head and associated engine block with a polymeric "O" ring positioned within the associated grooves to effect sealing of the cylinder head to the engine block to simultaneously increase operating efficiency of the associated engine.

As there are a wide range of engine designs, slight modification to the head of the pistons may be required in some circumstances when implementing the "cylinder head gasket elimination process". The shape of the head of the pistons vary from engine to engine and in some instances they might need to be modified.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
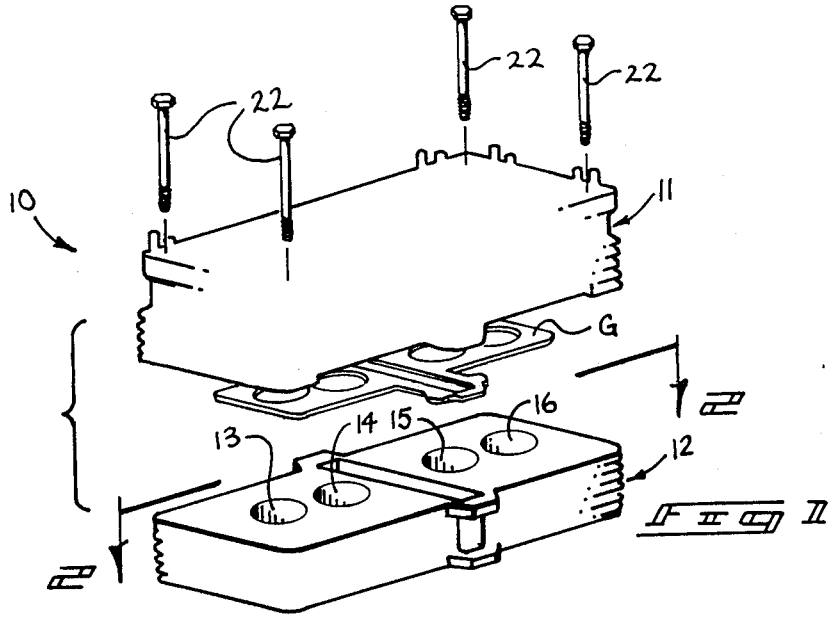
FIG. 1 is an isometric illustration of a conventional cylinder head removed from an associated engine block.

With reference now to the drawings, and in particular to FIGS. 1 to 4 thereof, a new and improved cylinder head gasket elimination process embodying the principles and concepts of the present invention and generally designated by the reference numeral 10 will be described.

More specifically, it will be noted that the cylinder head gasket elimination process essentially comprises removal of a conventional cylinder head 11 from an associated engine block 12. The associated and sandwiched gasket "G" is discarded. The cylinder head 12 is formed with a series of cylinder bores defined as a first cylinder bore 13, a second cylinder bore 14, a third cylinder bore 15, and a fourth cylinder bore 16. Subsequently, each of the cylinder bores 13 through 16 is formed with an annular groove defined as a first cylinder bore groove 17 about the first cylinder bore 13, a second cylinder bore groove 18 formed about the second cylinder bore 14, a third cylinder bore 19 formed about the third cylinder bore 15, and a fourth cylinder bore 20 formed about the fourth cylinder bore 16. Each of the grooves 17 through 20 are machined, such as in the utilization of a milling machine or a scoring tool (not illustrated), to form the grooves. The grooves are of a rectangular cross-sectional configuration and are defined by a groove diameter greater than that of the associated cylinder bore diameter. It should be understood that in the removal of the cylinder head 11, securement bolts 22 are threadedly withdrawn from the associated engine block 12 and are directed through threaded bolt apertures 21 formed within the cylinder block to receive the associated bolts 22.

Figure 2:
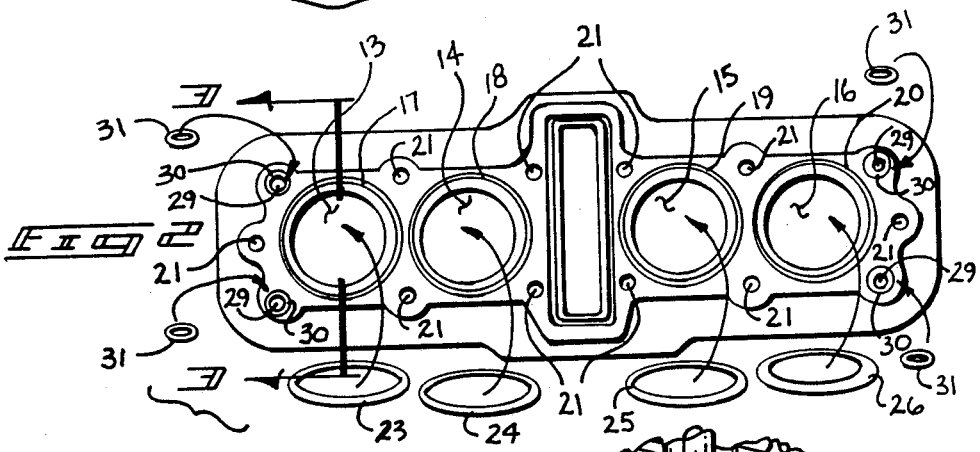
FIG. 2 is an orthographic view taken along the lines 2—2 of FIG. 1 in the direction indicated by the arrow illustrating a further step of forming grooves in the associated engine block.
Figure 3:
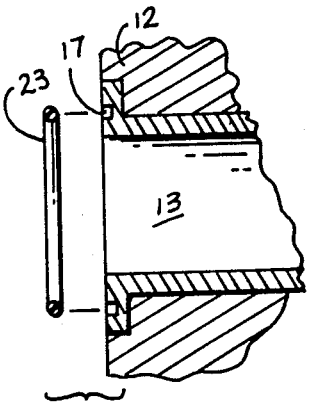
FIG. 3 is an orthographic view taken along the lines 3—3 of FIG. 2 in the direction indicated by the arrows.
Figure 4:
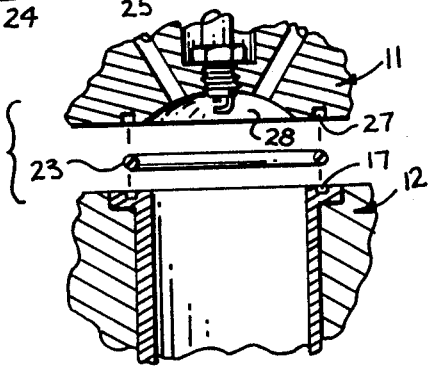
FIG. 4 is an orthographic view of the cylinder head and associated engine block and the positioning of an associated resilient "O" ring therebetween.

Further, the associated cylinder head is formed with a cylinder head groove 27 (as illustrated in FIG. 4 for example) wherein each of the cylinder head grooves 27 are of a diameter greater than that of the associated combustion chamber 28 and are of a diameter equal to the groove diameter of the respective first through fourth cylinder bore grooves 17 through 20 formed within the companion cylinder block. The cylinder head grooves 27 are also of a rectangular cross-sectional configuration, and it is understood that the cross-sectional area of the cylinder bore groove and its cooperating combustion chamber groove are of a combined cross-sectional area less than that of the cross-sectional area defined by an associated "O" ring 23 through 26 to be positioned about the associated cylinder bores 13 through 16, as illustrated in FIG. 2 for example.

Further, the engine block and associated cylinder head is formed with coolant channels 29 wherein a similar coolant channel groove 20 is formed within the engine block 12 and the cylinder head 11, and wherein the coolant channel grooves within the engine block and the cylinder head are also of a cross-sectional area less than the cross-sectional area of the coolant channel "O" ring 31 to be positioned within the engine block and cylinder head.

In this manner, the respective cylinder bore "O" rings 23 through 26, as well as the coolant channel "O" rings 31 are compressed within their respective grooves formed within the engine block and cylinder head and expand to effect a compressive seal within the associated grooves when the cylinder head 11 is secured to the engine block 12 by means of the associated securement bolts 22. Furthermore, elimination of the head gasket "G" will effectively raise the compression ratio of the associated engine and accordingly increase engine efficiency and response during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to on skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A process for eliminating a cylinder head gasket from an internal combustion engine comprising the steps of, a. providing an internal combustion engine including an engine block with at least one cylinder bore formed to said engine block of a first diameter, and wherein said engine block includes at least one engine block coolant line, and a cylinder head associated and overlying the engine block wherein at least one combustion chamber is formed within said cylinder head in overlying relationship to said cylinder bore, and a cylinder head coolant line in fluid communication with said engine block coolant line, with a plurality of securement bolts directed through said cylinder head and threadedly received within said engine block with a cylinder head gasket sandwiched between said engine block and said cylinder head, and b. threadedly removing the securement bolts, removing said cylinder head from said engine block, and discarding the cylinder head gasket, and c. forming a groove of a second diameter about the cylinder bore wherein the groove's second diameter is greater than the first diameter, and d. forming a cylinder head groove coaxially aligned with the groove formed in the engine block wherein the cylinder head groove is of a diameter equal to the second diameter, and e. inserting an easily compressible continuous "O" ring seal of a diameter equal to the second diameter within the engine block groove and cylinder head groove and inserting the securement bolts through the cylinder head and compressing the "O" ring within the overlying engine block groove and cylinder head groove to provide sealing against loss of combustion pressure.

2. A process for eliminating a cylinder head gasket as set forth in claim 1 wherein the engine block groove and the cylinder head groove are formed of a rectangular cross-sectional configuration.

3. A process for eliminating a cylinder head gasket as set forth in claim 2 wherein the cylinder head groove and the engine block groove define a total cross-sectional area less than that defined by a further cross-sectional are defined by the "O" ring.

4. A process for eliminating a cylinder head gasket as set forth in claim 3 wherein the cylinder head is secured to the engine block to compress the "O" ring within the cylinder head groove and engine block groove, and wherein the "O" ring is compressed to completely fill the "O" ring groove and cylinder head groove.

* * * * *